US005727583A

United States Patent [19]

Kennedy

[11] Patent Number: 5,727,583

[45] Date of Patent: Mar. 17, 1998

[54] SERVICE UMBRELLA

[76] Inventor: Phillip Donald Kennedy, 15920 NE. 1st Cir., Vancouver, Wash. 98684

[21] Appl. No.: 820,580

[22] Filed: Mar. 19, 1997

[51] Int. Cl.[6] ..... A45B 11/00

[52] U.S. Cl. ..... 135/20.1; 135/15.1; 135/16; 135/20.1; 135/25.4; 135/96; 135/98; 248/514; 248/537

[58] Field of Search ..... 135/15.1, 16, 20.1, 135/25.4, 96, 98; 248/206.5, 514, 515, 537

[56] References Cited

U.S. PATENT DOCUMENTS

| | | | |
|---|---|---|---|
| 3,407,825 | 10/1968 | Doyle . | |
| 3,765,434 | 10/1973 | Riggs . | |
| 3,802,112 | 4/1974 | Banner | 248/514 X |
| 4,303,054 | 12/1981 | Lore | 248/206.5 X |
| 5,029,799 | 7/1991 | Bernier | 248/514 |
| 5,150,728 | 9/1992 | Stark . | |
| 5,163,652 | 11/1992 | King | 248/515 X |
| 5,318,055 | 6/1994 | Olaniyan | 135/16 |
| 5,320,322 | 6/1994 | Williams | 248/514 |
| 5,323,996 | 6/1994 | Rendall | 248/206.5 X |
| 5,385,161 | 1/1995 | Loker et al. | 248/537 X |
| 5,396,915 | 3/1995 | Bomar . | |
| 5,431,364 | 7/1995 | Etter | 248/514 |
| 5,458,306 | 10/1995 | O'Farrill et al. | 248/514 X |
| 5,472,166 | 12/1995 | Wear | 248/514 |
| 5,520,141 | 5/1996 | Lutz | 248/514 X |

*Primary Examiner*—Wynn E. Wood
*Attorney, Agent, or Firm*—Patent & Trademark Services; Thomas Zack; Joseph H. McGlynn

[57] ABSTRACT

A base used to support an overhead pole and canopy or umbrella. The base has a strong lower magnet and two spaced vertical members each of which has a plurality of pin positioning and retaining holes. A pivotally connected support arm is positioned between the vertical members and pivotally attached to the base at its lower end. A pole with a canopy may be mounted on the support arm's other upper end and oriented at a desired angle by inserting a pin into a positioning hole. A flexible gooseneck is provided in the pole's segments to join them together and permit added angular adjustments to the mounted attached canopy.

4 Claims, 1 Drawing Sheet

SERVICE UMBRELLA

BACKGROUND OF THE INVENTION

Anyone who has worked outside for extended periods of time knows the value of good overhead protection such as an umbrella to protect them from the sun, rain, hail, wind or snow or other increment weather. One particular field where protective umbrellas are especially needed is the field concerned with heating, ventilation, air conditioning or refrigeration (HVACR) work performed outdoors. Unless the umbrella has an inordinately large canopy area it needs to be readjusted to take into consideration changing conditions such as variations in the sun's position during the daytime, wind changes, or different rainfall directions. Outdoor adjacent base surfaces conditions may limit the umbrella's pole readjustments and its overhead canopy for different angular orientations. The present invention provides for a multi-orientation adjustable pole mount base having a strong holding magnet for the pole to permit its attachment to a variety of commonly found articles as set forth herein.

DESCRIPTION OF THE PRIOR ART

Many types of umbrella holders are known in the prior art. For example, in U.S. Pat. No. 3,407,825 to Doyle discloses an umbrella holder supported by a manhole guard rail or a platform's strand. The Riggs invention (U.S. Pat. No. 3,765,434) describes an umbrella with a foldable staff having two pivots for the connected sections. In the Stark reference (U.S. Pat. No. 5,150,728) magnetic canopy fasteners are used with an umbrella to attach it to the surface of a vehicle.

In U.S. Pat. No. 5,396,915 to Bomar an umbrella is supported on a riding lawn mower by a shaft with a pivotal bracket. The present invention provides for a magnetic base, attachable to any magnetically attractable metal surface, with a plurality of positioning holes oriented at different angles to hold a pivotally mounted canopy support at these different angular orientations. A pole in the support has a mounted overhead canopy for orientation at a desired position all as more fully set forth in this specification.

SUMMARY OF THE INVENTION

This invention relates to a base used to support an overhead pole and canopy. The base has a strong magnet and a plurality of positioning holes for orienting a pivotally connected support arm. A pole with an overhead canopy is mounted on the support arm and oriented at a desired angle. Gooseneck material in the pole is used to permit added adjustment of the pole's segments and canopy.

It is the primary object of the present invention to provide for an improved apparatus adjustably positional overhead canopy.

Another object is to provide for a magnetic base that supports the overhead canopy which can be attached to any magnetically attachable material.

These and other objects and advantages of the present invention will become apparent to readers from a consideration of the ensuing description and the accompanying drawings.

DESCRIPTION OF THE PREFERRED EMBODIMENT

Figure 1:
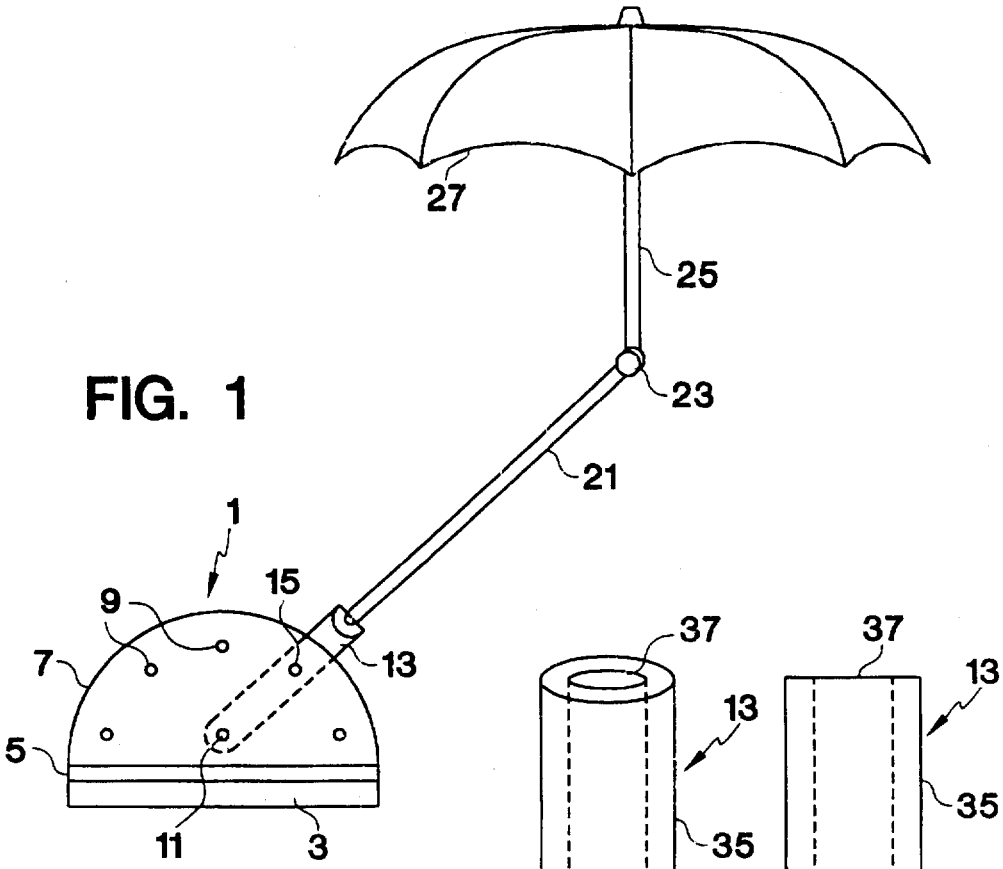
FIG. 1 is a side view of the invention's preferred embodiment.

FIG. 1 is a side view of the invention's preferred embodiment. The support base 1 has a lower 180 pound pull metal covered circular magnet 3. Held to and over this base by one or more bolts is a similarly shaped circular main aluminum base 5. Extending upward from base 5 are two attached spaced identical semi-circular positioning pin support members 7, the closer of which is shown in this figure with the other behind it. One or both of the support members 7 have several—five shown—pin positioning holes 9 extending completely through its surface. A horizontally disposed bolt 11 extends through both members 7 in aligned center holes 10 in each to provide a pivot point for the attached angularly adjustable arm support 13. This support arm is attached at its lower end to the side members 7 as shown by the dotted lines representing the support's lower hidden portion. A retaining positioning pin 15 on a ring is insertable into any of the holes 9 to engage an aligned upper hole 17 in the lower arm support 13 to maintain the arm at a desired angular orientation with respect to the support base 1.

There are two horizontally aligned holes 9 in each member 7 and a separate pin 15 insertable into each hole through its side into the support's hole 17. Alternately, there may be only one series of holes in one of the members 7 to receive the positioning pin 15 and insert it into the support hole 17. Extending upward from support arm 13 and mounted in it is the cylindrical upright umbrella pole 21. An interposed gooseneck multi-postional fitting 23 forms part of the pole structure to permit its lower and upper segments to be bent and oriented at different angular orientations with respect to each other. The pole's upper segment 25 supports a conventional overhead cover canopy or umbrella 27 that can be collapsible for carrying or when not used to protect those under it.

Figure 2:
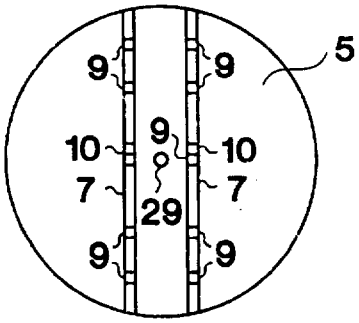
FIG. 2 is a top view of the base used in the FIG. 1 embodiment.

FIG. 2 is a top view of the base used in the FIG. 1 embodiment without its support arm, pole or umbrella. The two identical parallel spaced pin support members 7 are shown attached to lower base 5 to form a space in which support arm 13 (not shown in this figure) fits. A center hole 29 in base 5 may be used for a fastener (e.g., a bolt) to attach this base to its underlying similar shaped magnet 3.

Figure 3:
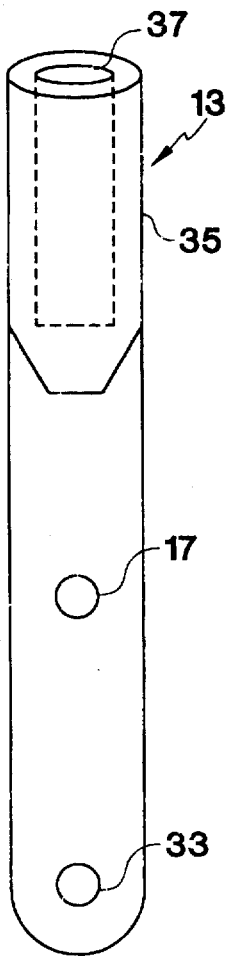
FIG. 3 shows a front view of the pole support.
Figure 4:
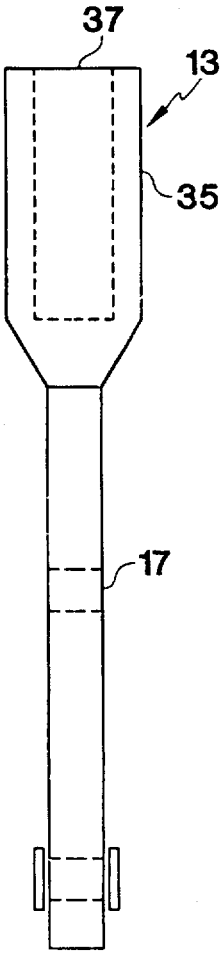
FIG. 4 shows a side view of the FIG. 3 pole support.

FIG. 3 shows a front view of the pole arm support 13 with its positioning pin hole 17 and its lower bolt receiving hole 33 used to receive bolt 11 via holes 10 and pivotally mount the arm between the two vertical members 7. The enlarged upper arm portion 35 has a center pole receiving recess or hole 37 extending lengthwise into the arm support into which the pole's 21 lower end can be inserted to mount the pole within the support arm 13. FIG. 4 shows a side view of the FIG. 3 pole support. In this view the hole 37 is shown in dotted line format extending downwardly into the upper arm portion 35.

Using a magnetic base permits the upper adjustable canopy to be attached to many different magnetically attachable metal support surfaces commonly found where outdoor HVACR is to be performed. This includes almost any nearby located material to which a magnet can be attracted such as sides of air conditioner units, heating ductwork, refrigerator sides, etc. It may also be used by employees of the phone company to provide an over canopy while working in or around magnetically attachable metal cases on it can be mounted.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A base used to support an overhead pole and protective canopy comprising:

a support base having a magnet near its lower surface and two spaced vertically disposed members, at least one of said members having a plurality of positioning holes through its surface defining different angular orientations;

a support arm pivotally mounted between said two spaced vertical members and connected to them, said support arm having a free end with means for receiving a positioning pin along its length and a pole and protective canopy near its free end; and a positioning and retaining pin insertable into any of the positioning holes to engage said support arm and hold it and a mounted pole and protective canopy in a desired angular orientation.

2. The invention as claimed in claim 1, wherein said vertically disposed members are substantially identical in shape with each having more than two pin positioning holes through its cross sectional surface.

3. The invention as claimed in claim 1, wherein said support arm means for receiving a positioning pin along its length and pole with a protective canopy near its end includes one hole through the arm near its upper end and another pole receiving hole extending lengthwise of the support arm.

4. The invention as claimed in claim 3, including a segmented pole with an attached protective canopy at its upper end inserted into said support arm, said pole having two segments joined together by a flexible connection to permit the segments to be moved and oriented at different angular relationships with respect to each other.

* * * * *